US010816189B2

(12) United States Patent
Pan

(10) Patent No.: US 10,816,189 B2
(45) Date of Patent: Oct. 27, 2020

(54) DISPLAY

(71) Applicant: Qisda Corporation, Taoyuan (TW)

(72) Inventor: Jiung-Cheng Pan, Taipei (TW)

(73) Assignee: Qisda Corporation, Taoyuan (TW)

( * ) Notice: Subject to any disclaimer, the term of this patent is extended or adjusted under 35 U.S.C. 154(b) by 0 days.

(21) Appl. No.: 16/406,141

(22) Filed: May 8, 2019

(65) Prior Publication Data

US 2019/0353343 A1 Nov. 21, 2019

(30) Foreign Application Priority Data

May 17, 2018 (CN) ..... 2018 1 0475662

(51) Int. Cl.

| | |
|---|---|
| ***F21V 33/00*** | (2006.01) |
| ***F21V 21/26*** | (2006.01) |
| ***F21V 23/04*** | (2006.01) |
| ***F21V 23/06*** | (2006.01) |
| *F21Y 103/10* | (2016.01) |

(52) U.S. Cl.

CPC ..... *F21V 33/0052* (2013.01); *F21V 21/26* (2013.01); *F21V 23/0471* (2013.01); *F21V 23/06* (2013.01); *F21Y 2103/10* (2016.08)

(58) Field of Classification Search

CPC .. F21V 33/0052; F21V 23/06; F21V 23/0471; F21V 21/26; F21V 33/00; F21V 23/0485; F21Y 2103/10; G09F 13/02; G09F 9/00

See application file for complete search history.

(56) References Cited

U.S. PATENT DOCUMENTS

| | | | | |
|---|---|---|---|---|
| 2006/0109620 | A1* | 5/2006 | Kim | G06F 1/1632 361/679.4 |
| 2013/0194775 | A1* | 8/2013 | Geddes | F21S 4/28 362/11 |
| 2013/0229594 | A1* | 9/2013 | Son | G02F 1/133606 349/61 |
| 2015/0257658 | A1* | 9/2015 | Geesbreght | A61B 5/0205 600/301 |
| 2015/0362148 | A1* | 12/2015 | Katz | F21S 6/003 362/16 |

FOREIGN PATENT DOCUMENTS

| | | | | |
|---|---|---|---|---|
| CN | 202870705 U | * | 4/2013 | F21V 33/0052 |
| CN | 107631190 A | * | 1/2018 | |

OTHER PUBLICATIONS

Machine English Translation of CN107631190A, Cai Changyu, Jan. 26, 2018 (Year: 2018).*

* cited by examiner

*Primary Examiner* — Isiaka O Akanbi
*Assistant Examiner* — Glenn D Zimmerman

(57) ABSTRACT

A display includes a display panel and a lighting device. The lighting device includes a display surface, a back surface, and upper frame surface and a socket. The upper frame surface is located between the display surface and the back surface opposite to each other, and the socket is provided at the upper frame surface. The lighting device is disposed in a pluggable manner on the socket, and includes a light source. When the light source is disposed on the socket, the light source forms a lighting area on a light exiting side of the display surface, wherein the lighting area is non-overlapping with the display surface.

18 Claims, 4 Drawing Sheets

DISPLAY

This application claims the benefit of People's Republic of China application Serial No. 201810475662.2, filed May 17, 2018, the subject matter of which is incorporated herein by reference.

BACKGROUND OF THE INVENTION

Field of the Invention

The invention relates in general to a display, and more particularly to a display having a pluggable lighting device.

Description of the Related Art

When a user using a display usually, the user not only pays much attention to the screen of the display but also needs to read documents on a desk. It is necessary to put an additional light source on the desk to provide sufficient lighting for reading documents. However, a conventional lighting device (e.g., a table lamp) can only be placed on the right or left of the screen and hence can merely provide a regional lighting range. Further, the lighting range provided by such table lamp is asymmetrical and non-uniform, and cannot thoroughly cover the entire desk space. Moreover, the table lamp occupies a space on the desk, and a part of the light may fall upon the screen and cause reflection of the light. Also, the table lamp needs an additional power supply, which causes inconvenience.

SUMMARY OF THE INVENTION

The invention is directed to a display having a lighting device. The lighting device is disposed on a socket of a display panel, and the light emits therefrom is irradiated on only a desk area in front of the display surface instead of on a display surface of the screen. Further, the lighting device can provide a symmetrical and uniform lighting area to cover the desk area in front of the screen. Further, the lighting device does not occupy any space on the desk and no additional power supply is needed, providing a more convenient application. In addition, in one embodiment of the present invention, the lighting device can serve as a background light source so as to adjust brightness or contrast of an ambient environment of the display.

According to an aspect of the present invention, a display is provided. The display includes a display panel and a lighting device. The display panel includes a display surface, a back surface, an upper frame surface and a socket. The upper frame surface is located between the display surface and the back surface opposite to each other, and the socket is provided at the upper frame surface. The lighting device is disposed in a pluggable manner on the socket, and includes a light source. When the lighting device is disposed on the socket, the light source forms a lighting area on a light exiting side of the display surface, wherein the lighting area is non-overlapping with the display surface.

According to another aspect of the present invention, a display is provided. The display includes a display panel and a lighting device. The display panel includes a display surface, a back surface, an upper frame surface and a socket. The upper frame surface is located between the display surface and the back surface opposite to each other, and the socket is provided at the upper frame surface. The lighting device is disposed in a pluggable manner on the socket. The socket is a Universal Serial Bus (USB) socket that can be plugged in a forward direction or a reverse direction by the lighting device.

The above and other aspects of the invention will become better understood with regard to the following detailed description of the preferred but non-limiting embodiments. The following description is made with reference to the accompanying drawings.

DETAILED DESCRIPTION OF THE INVENTION

Embodiments are described in detail below. The embodiments serve as examples for illustrations and are not to be construed as limitations to the claimed scope of the present invention. The same/similar denotations are used below to represent the same/similar components.

Figure 1:
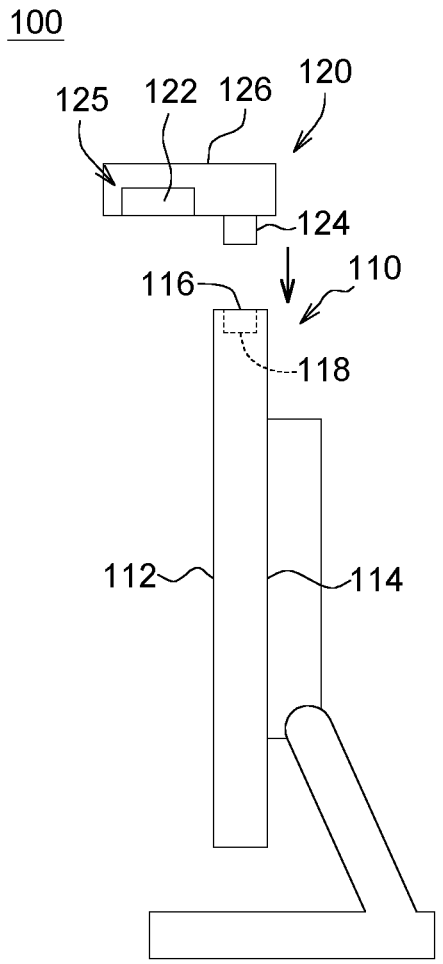
FIG. 1 is a schematic diagram of a display according to an embodiment of the present invention, wherein a lighting device is not plugged in a socket.
Figure 2A:
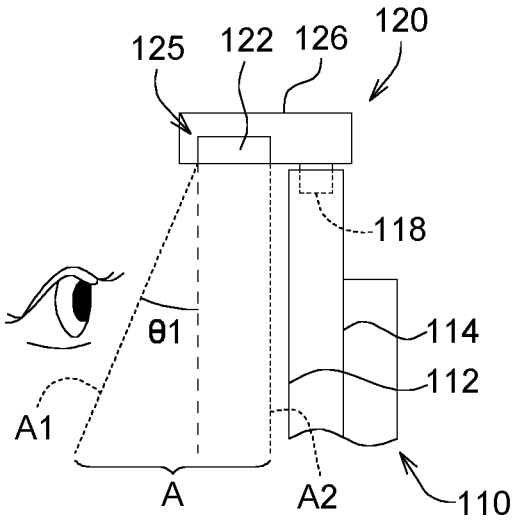
FIG. 2A is a schematic diagram of a display according to an embodiment of the present invention, wherein the lighting device is disposed in forward direction above the display and the a lighting area does not overlap with a display surface.

Referring to FIG. 1 and FIG. 2A, a display 100 according to an embodiment of the present invention includes a display panel 110 and a lighting device 120. The lighting device 120 is disposed in a pluggable manner on the display panel 110, and the display panel 110 can provide the lighting device 120 with a required power supply and control turning on or turning off of the lighting device 120. In one embodiment, the display panel 110 includes, for example, a Universal Serial Bus (USB) power supply or a direct-current (DC) power supply, e.g., a 5 V, 9 V or 12 V voltage source, and can be coupled to the lighting device 120 by a USB power line or other transmission interfaces. Further, the display panel 110 includes, for example, a parameter configuration unit, which can be coupled to the lighting device 120 by a USB signal line or other transmission interfaces to control turning on or turning off of the lighting device 120 or to adjust other parameters.

Referring to FIG. 1, the display panel 110 includes a display surface 112, a back surface 114, an upper frame surface 116 and a socket 118. The upper frame surface 116 is located between the display surface 112 and the back surface 114 opposite to each other. The socket 118 is provided at the upper frame surface 116. Referring to FIG. 2A, the lighting device 120 is disposed in a pluggable manner on the socket 118, and includes a light source 122. When the lighting device 120 is disposed on the socket 118, the light source 122 forms a lighting area A on a light exiting side of the display surface 112, wherein the lighting area A is non-overlapping with the display surface 112.

In one embodiment, the socket 118 is, for example, a USB socket, and can match with a plug of the lighting device 112, so as to assemble the lighting device 120 at the upper frame surface 116 of the display panel 110. In one embodiment, the lighting device 120 includes a fixing seat 124 and a lamp cover 126. The fixing seat 124 is, for example, a USB connector and is electrically connected to the socket 118. The lamp cover 126 can extend horizontally from the fixing seat 124 towards a direction of the user, and has, for example, a recess 125 towards the lighting area A. Further, the light source 122 is located in the recess 125 of the lamp cover 126, and emits light towards the lighting area A, such that the lighting device 120 can illuminate one lighting area A in front of the display panel 110 (i.e., a light exiting side of the display surface 112). The lighting area A is, for example, an area on the desk where the user operates a mouse or places a keyboard, or an area of the desk where documents or books are placed.

Figure 3:
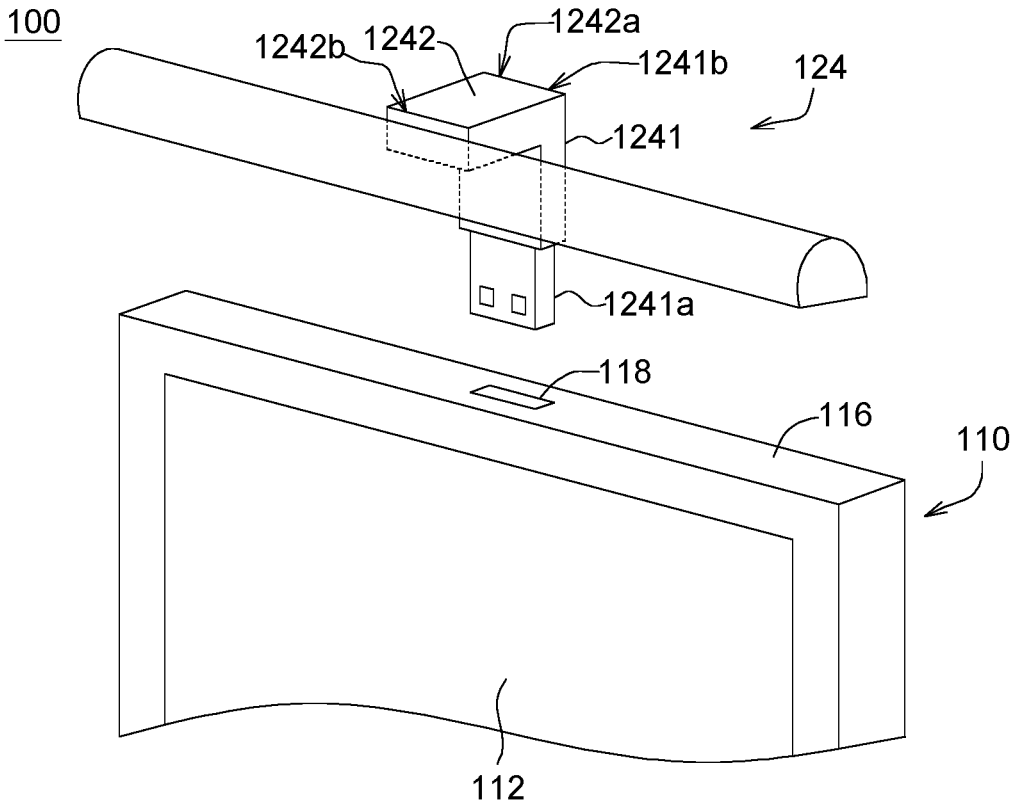
FIG. 3 is a schematic diagram of a display according to an embodiment of the present invention, wherein a lighting device is not plugged in a socket.

In one embodiment, the width of the lighting area A is preferably greater than the width of the display surface 110, and the lighting area A is horizontally symmetrical and has uniform brightness. As shown in FIG. 3, the lamp cover 126 of the lighting device 120 is, for example, strip-shaped, and the light source 122 is, for example, a light strip formed by light tubes or light-emitting diodes (LED) in a linear arrangement so as to provide sufficient lighting; however, the present invention is not limited to the above examples.

Referring to FIG. 2A, when the lighting device 120 is disposed in a forward direction on the socket 118, the lighting area A and the light exiting surface of the display surface 112 are located on the same side. Further, the lamp cover 126 can define an angle of the light emitted from the recess 125 by the light source 122 relative to the display surface 112, so as to prevent reflection caused by light reflected by the display surface 112 or screen frame thereof, and also to prevent the light from entering the eye and from causing the user discomfort.

In one embodiment, the lighting area A has a first edge A1 and a second edge A2, wherein the second edge A2 is closer to the display surface 112 compared to the first edge A1. A first angle θ1 exists between the first edge A1 and the display surface 112, and a second included angle (not shown) exists between the second edge A2 and the display surface 112. That is to say, an extension line of the first edge A2 intersects the plane where the display surface 112 is located to form the first angle θ1, and an extension line of the second edge A2 intersects the plane where the display surface 112 is located to form the second included angle. When the second edge A2 is parallel to the display surface 112, it means that the light can hardly be irradiated on the display surface 112, and the second angle at this point can be 0 degree or approximate 0 degree; however, the present invention is not limited to the above example.

The first included angle θ1 is greater than the second included angle. For example, the second angle is 0 degree, and the first included angle θ1 is greater than 0 degree and smaller or equal to 60 degrees. In this embodiment, the lighting device 120 can adjust a light exiting angle of the light source 122 by means of the shape of the recess 125 of the lamp cover 126 or by a light tuning piece or a light blocking piece provided at the recess 125, such that a light pattern outputted from the lighting device 120 is asymmetrical and the display surface 112 is not in the lighting area A, thereby providing lighting giving a better sense of comfort.

Figure 2B:
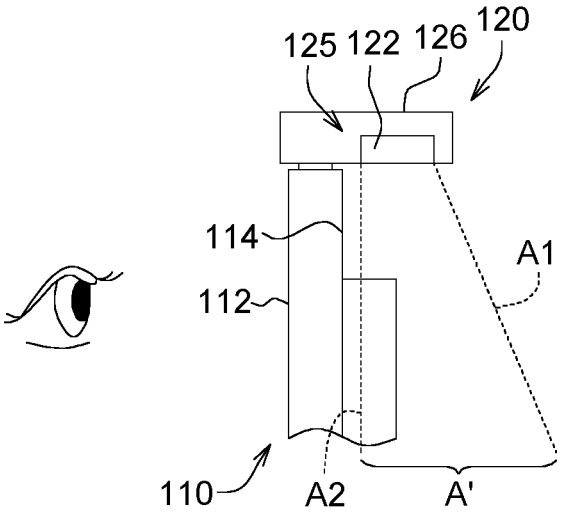
FIG. 2B is a schematic diagram of a display according to an embodiment of the present invention, wherein the lighting device is disposed in a reverse direction above the display to serve as a background light source.

Referring to FIG. 2B, a difference of FIG. 2B from the above embodiment is that, in the display device 100 of this embodiment, the lighting device 120 can be provided in a reverse direction on the display panel 110 to serve as a background light source. That is to say, the lamp cover 126 of the lighting device 120 can extend horizontally from the fixing seat 124 towards a direction away from the user, such that the light source 122 emits light from the recess 125 towards a lighting area A' in front of the back surface 114 of the display panel 110, further illuminating a lighting area A' right behind the display panel 110 (opposite to a light exiting side of the display surface 112). The lighting area A' is, for example, an area on a desk and/or an area of a wall behind the display panel 110.

When the lighting device 120 is disposed in a reverse direction on the display panel 110, the light pattern outputted from the lighting device 120 can be asymmetrical, or be adjusted to other appropriate light patterns instead of being an asymmetrical light pattern. Further, because the display surface 112 and the lighting area A' of the lighting device 120 are located on two opposite sides of the display panel 110 and do not interfere each other, the brightness of the ambient environment of the display panel 110 can be correspondingly adjusted according to user requirements.

In one embodiment, the socket 118 is preferably a USB socket that can be plugged in both forward and reverse directions by the lighting device 120, for example, a Type-C USB socket, for disposing the lighting device 120 in a forward direction or a reverse direction on the display panel 110. Further, when the socket 118 only allows the lighting device 120 to be disposed unidirectionally thereon, for example, a Type-A or Type-B USB socket, a rotation mechanism can be used to rotate the lighting device 120 to the front of or behind the display panel 110, thus achieving dual effects of forward and reverse use.

Figure 4A:
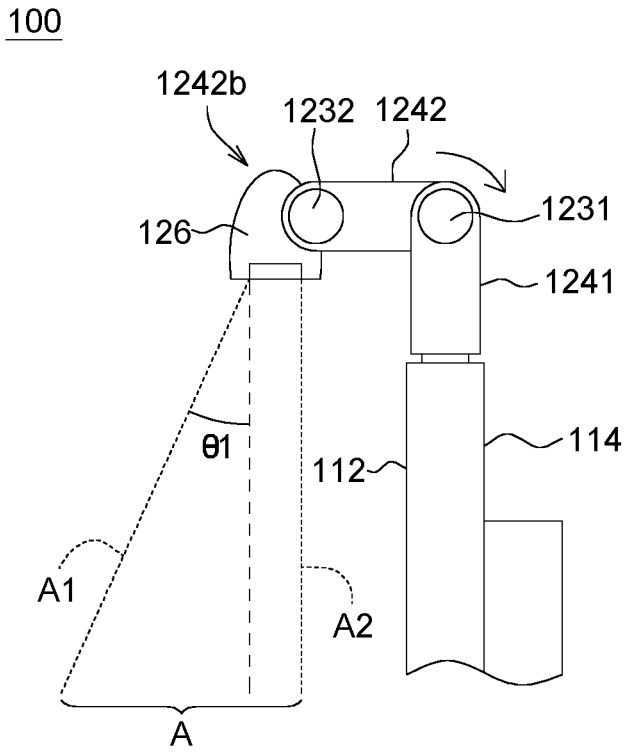
FIG. 4A and FIG. 4B are schematic diagrams of a display according to another embodiment of the present invention, wherein a lamp cover is capable of rotating relative to a first rotation shaft and a second shaft.
Figure 4B:
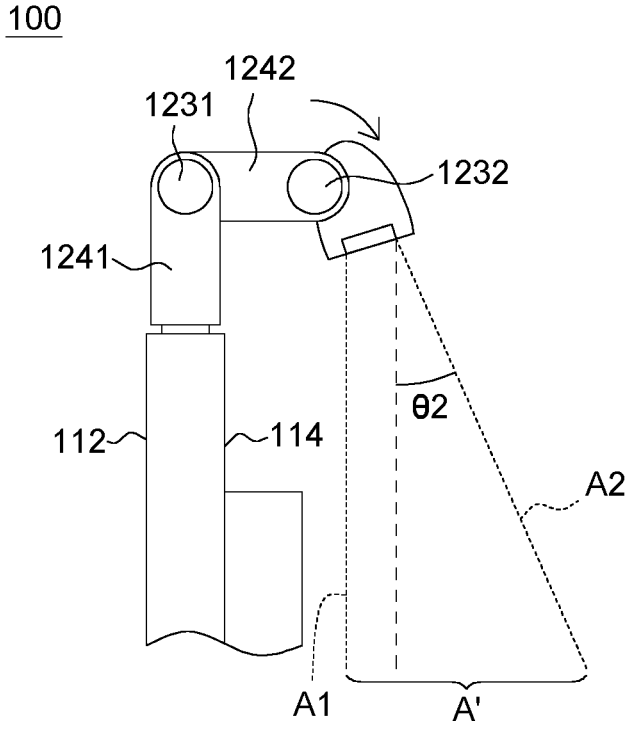

Referring to FIGS. 3, 4A and 4B, the fixing seat 124 can include a first support portion 1241 and a second support portion 1242. A first terminal 1241*a* of the first support portion 1241 is electrically connected to the socket 118; that is to say, the first terminal 1241*a* of the first support portion 1241 is an electrical connector. A first terminal 1242*a* of the second support portion 1242 is connected to a second terminal 1241*b* of the first support portion 1241, and a second terminal 1242*b* of the second support portion 1242 is connected to the lamp cover 126. In FIG. 3, the first support portion 1241 and the second support portion 1242 are integrated to form, for example, an L-shaped support member, allowing the lighting device 120 to be disposed in a forward direction or a reverse direction on the display panel 110.

In FIG. 4A, the fixing seat 124 can further include a first rotation shaft 1231 provided on the first support portion 1241. The first terminal 1242*a* of the second support portion 1242 can be connected to the second terminal 1241*b* of the second support portion 1241 by the first rotation shaft 1231. In FIGS. 4A and 4B, when the second support portion 1242 rotates clockwise relative to the first rotation shaft 1231, the lamp cover 126 can be rotated to in front of the back surface 114 of the display panel 110 to provide a background light source.

In FIG. 4A, the lamp cover 126 can further include a second rotation shaft 1232, which is connected to the second terminal 1242*b* of the second support portion 1242. In FIG. 4B, the second rotation shaft 1232 allows the lamp cover 126 to rotate relative to the second support portion 1242, and causes the second included angle θ2 to change between 0 degree and 60 degrees. At this point, the first edge A1 of the lighting area A' is closer to the back surface 114 compared to the second edge A2, and thus an included angle between the second edge A2 of the lighting area A' and the back surface 114 is defined as a second included angle θ2 (equivalent to the first included angle θ1 defined in FIG. 2A), and an included angle between the first edge A1 of the lighting area A' and the back surface 114 is defined as a first included angle (equivalent to the second included angle defined in FIG. 2A), wherein the second included angle θ2 is, for example, greater than the first included angle; however, the second included angle θ2 can also be smaller than or equal to the first included angle.

Figure 5A:
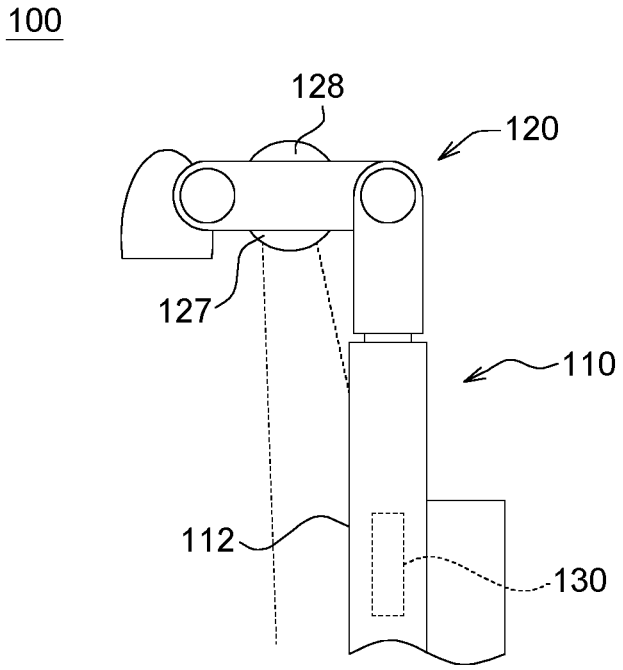
FIG. 5A and FIG. 5B are schematic diagrams of a display according to another embodiment of the present invention, wherein the lighting device is provided with at least one sensor.

Referring to FIG. 5A, in one embodiment, the display 100 includes, for example, a parameter configuration module 130 and at least one of sensors 127 and 128. The parameter configuration module 130 configures parameters of the display panel 110 and parameters of the lighting device 120, for example, brightness and chrominance parameters. The sensors 127 and 128 detect the parameters of the display panel 110 and/or parameters of the ambient environment of the display panel 110 (e.g., brightness or chrominance). Upon detection of a change in the parameter of the display panel 110, the parameter configuration module 130 can correspondingly adjust the parameter (e.g., brightness or chrominance) of the lighting device 120 according to the parameter of the display panel 110.

Further, upon detection that the brightness of the display panel 112 is greater than the brightness of the ambient environment of the display panel 110, to prevent overly high brightness of a display image, the parameter configuration module 130 can correspondingly adjust of the brightness parameter (e.g., increasing the brightness) of the lighting device 120 according to the parameters (e.g., brightness or chrominance) of the display surface 112 and the ambient environment thereof. Alternatively, upon detection that the brightness of the display surface 112 is smaller than the brightness of the ambient environment of the display panel 110, the parameter configuration module 130 can correspondingly adjust the parameter (e.g., reducing the brightness) of the lighting device 120 according to the parameters (e.g., brightness of chrominance) of the display surface 112 and the ambient environment thereof.

Figure 5B:
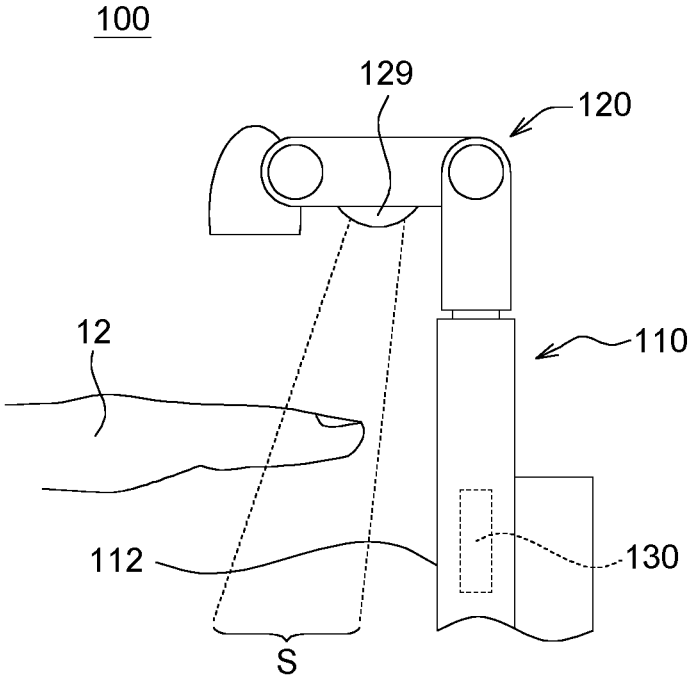

Referring to FIG. 5B, in one embodiment, the sensor 129 can detect a gesture in front of the display surface 112. For example, multiple sensors 129 can be arranged below the lighting device 120 and emit infrared light towards the light exiting surface of the display surface 112, so as to form a sensing region S at the light exiting side of the display surface 112. When the sensors 129 sense a finger 12 of a user in the sensing region S, the lighting device 120 can execute an instruction according to the gesture (e.g., sliding or staying at one fixed point), for example, turning on or turning off the light source 122, or adjusting the brightness or chrominance parameters of the light source 122. Further, detected signals of the sensor 129 can be transmitted to the parameter configuration unit 130 in the display 100 through the socket 118, for the display panel 110 to adjust corresponding parameters (e.g., turning on or tuning off a power supply, or adjusting the brightness of the display surface 112 or switching an image on the display surface 112).

The display disclosed by the above embodiments of the present invention includes a lighting device. The lighting device can be disposed in a forward direction or a reverse direction on the socket of the display panel, and the light emits therefrom is irradiated only upon a desk area in front of the display or a lighting area behind the display instead of upon a display surface of the display. The lighting device can serve as a background light source, so as to adjust the brightness or contrast of the ambient environment of the display. Further, the lighting device can provide a symmetrical and uniform lighting area to cover a desk area in front of the screen. Moreover, the lighting area does not occupy any desk space, and does not require an additional power supply, thus providing a more convenient application.

While the invention has been described by way of example and in terms of the preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A display, comprising:

a display panel, comprising a display surface, a back surface, an upper frame surface and a socket, the upper frame surface located between the display surface and the back surface opposite to each other, the socket provided at the upper frame surface; and a lighting device, disposed in a pluggable manner on the socket, the lighting device comprising:

a light source, the light source forming a lighting area on a light exiting side of the display surface when the lighting device is disposed on the socket, the lighting area being non-overlapping with the display surface;

a fixing seat; and a lamp cover, wherein the fixing seat comprises a first support portion and a second support portion, a first terminal of the first support portion is electrically connected to the socket, a first terminal of the second support portion is connected to a second terminal of the first support portion, a second terminal of the second support portion is connected to the lamp cover.

2. The display according to claim 1, wherein the lighting area has a first edge and a second edge, the second edge is closer to the display surface compared to the first edge, a first included angle exists between the first edge and the display surface, a second included angle exists between the second edge and the display surface, and the first included angle is greater than the second included angle.

3. The display according to claim 1, wherein the fixing seat further comprises a first rotation shaft, and the first rotation shaft is provided on the first support portion and the lamp cover is rotated to in front of the back surface via the first rotation shaft.

4. The display according to claim 1, wherein the lamp cover further comprises a second rotation shaft connected to the second terminal of the support portion, and the lamp cover is rotated relative to the second support portion via the second rotation shaft such that the second included angle changes between 0 degree and 60 degrees.

5. The display according to claim 1, further comprising:

at least one parameter configuration module, for configuring at least one parameter of the display panel and at least one parameter of the lighting device, the at least one parameter of the lighting device being correspondingly adjusted when the at least one parameter of the display panel or an ambient environment of the display panel changes.

6. The display according to claim 1, wherein the lighting device further comprises a sensor for detecting a gesture in front of the display surface.

7. The display according to claim 2, wherein the first included angle is greater than 0 degree and smaller than or equal to 60 degrees.

8. The display according to claim 2, wherein the light source is located in a recess of the lamp cover, the light source emits light towards the lighting area, and the lamp cover defines the first included angle and the second included angle of the light emitted from the recess by the light source relative to the display surface.

9. The display according to claim 6, wherein a signal detected by the sensor is transmitted into the display through the socket.

10. A display, comprising:

a display panel, comprising a display surface, a back surface, an upper frame surface and a socket, the upper frame surface located between the display surface and the back surface opposite to each other, the socket provided at the upper frame surface; and a lighting device, disposed in a pluggable manner on the socket, wherein the socket is a Universal Serial Bus (USB) socket allowing the lighting device to be selectively disposed in a forward direction and a reverse direction, the lighting device comprises;

a fixing seat; and a lamp cover, wherein the fixing seat comprises a first support portion and a second support portion, a first terminal of the first support portion is electrically connected to the socket, a first terminal of the second support portion is connected to a second terminal of the first support portion, a second terminal of the second support portion is connected to the lamp cover.

11. The display according to claim 10, wherein the lighting device comprises a light source, the light source forms a lighting area on a light exiting side of the display surface when the lighting device is disposed on the socket in the forward direction, and the lighting area is non-overlapping with the display surface.

12. The display according to claim 10, wherein the fixing seat further comprises a rotation shaft, the first rotation shaft is provided on the first support portion and the lamp cover is rotated to in front of the back surface.

13. The display according to claim 10, wherein the lamp cover further comprises a second rotation shaft connected to the second terminal of the support portion, and the lamp cover is rotated relative to the second support portion via the second rotation shaft such that the second included angle changes between 0 degree and 60 degrees.

14. The display according to claim 10, further comprising:

at least one parameter configuration module, for configuring at least one parameter of the display panel and at least one parameter of the lighting device, the at least one parameter of the lighting device being correspondingly adjusted when the at least one parameter of the display panel or an ambient environment of the display panel changes.

15. The display according to claim 10, wherein the lighting device further comprises a sensor for detecting a gesture in front of the display surface.

16. The display according to claim 11, wherein the first lighting area has a first edge and a second edge, the second edge is closer to the display surface compared to the first edge, a first included angle exists between the first edge and the display surface, a second included angle exists between the second edge and the display surface, and the first included angle is greater than the second included angle.

17. The display according to claim 16, wherein the first included angle is greater than 0 degree and smaller than or equal to 60 degrees.

18. The display according to claim 16, wherein the light source is located in the lamp cover and emits light towards the lighting area, the lamp cover defines the first included angle and the second included angle of the light emitted from the recess by the light source relative to the display surface.

* * * * *